United States Patent [19]

Ho

[11] 3,964,218

[45] June 22, 1976

[54] PREFABRICATED ROOFING STRUCTURE

[75] Inventor: Jack H. Y. Ho, Haig Road, Singapore

[73] Assignee: Unifab Housing, Inc., Los Angeles, Calif.

[22] Filed: Jan. 31, 1975

[21] Appl. No.: 545,725

[52] U.S. Cl. ..... 52/90; 52/481; 52/484

[51] Int. Cl.[2] ..... E04B 7/02; E04B 5/52

[58] Field of Search ..... 52/22, 90, 92, 93, 474, 52/481, 484, 486, 487, 488, 647, DIG. 10

[56] References Cited

UNITED STATES PATENTS

| | | | |
|---|---|---|---|
| 1,753,892 | 4/1930 | Klingenberg | 52/90 X |
| 2,270,161 | 1/1942 | Briggs | 52/92 |
| 3,660,952 | 5/1972 | Wilson | 52/DIG. 10 |
| 3,842,561 | 10/1974 | Wong | 52/484 |

FOREIGN PATENTS OR APPLICATIONS

| | | | |
|---|---|---|---|
| 155,843 | 3/1954 | Australia | 52/90 |

*Primary Examiner*—J. Karl Bell
*Attorney, Agent, or Firm*—Ralph B. Pastoriza

[57] ABSTRACT

The roofing structure includes roof sheets forming an inverted V-shape, together with a plurality of inverted T-bars extending between and secured to the lower ends of the roof sheets. Turnbuckles are provided in each T-bar to provide a contracting force tending to pull the ends of the T-bars towards each other and thus counter the gravitational force component tending to spread the lower ends of the roof sheets. The T-bars serve an additional function in defining support areas for ceiling panels in the form of the horizontal cross portions of the inverted T-shapes.

2 Claims, 5 Drawing Figures

PREFABRICATED ROOFING STRUCTURE

This invention relates generally to building construction and more particularly to an improved prefabricated roofing structure useful in the construction of prefabricated type small housing units and the like.

BACKGROUND OF THE INVENTION

Normal roof structures of the inverted V-shape have a tendency to spread at the lower ends of the roof sheets where they meet the bearing walls of a building. It is normal practice, accordingly, to provide cross beams secured to underside portions of the roof sheets to prevent such spreading. In addition, a ceiling is usually installed to block from view the cross beams and roof rafters or stiffening ribs and also provide the usual insulating air space.

In prefabricated type housing units, the roof may be prefabricated in the form of roof sheets which slant downwardly from a center ridge member. In these constructions, the same problems exist with respect to the gravitational component of force tending to spread the lower ends of the roof sheets and thus exert forces on the upper edges of the bearing walls tending to spread the walls. It would be desirable to provide a more efficient and simplified means for countering this spreading force which not only can be adjusted after the roofing structure is in place, but also can serve additional functions all to the end that more economical assembly is possible, both from the material and labor standpoints.

BRIEF DESCRIPTION OF THE PRESENT INVENTION

With the foregoing in mind, the present invention contemplates an improved prefabricated roofing structure wherein the same elements utilized for countering the normal spreading force of the lower ends of the roof sheets serve the additional function of supports for suitable ceiling panels.

Briefly, the invention contemplates roof sheets forming an inverted V-shape for the roof together with a plurality of inverted T-bars extending between and secured to the lower ends of the roof sheets. Each of the T-bars includes turnbuckle means such that tightening of the turnbuckle means provides a pulling force countering the gravitational force components tending to spread apart the roof sheets. In addition, the inverted cross portions of the T-bars serve as a support means for ceiling panels extending between the T-bars.

BRIEF DESCRIPTION OF THE DRAWINGS

A better understanding of the invention will be had by referring to the accompanying drawings in which.

DETAILED DESCRIPTION OF THE INVENTION

Figure 1:
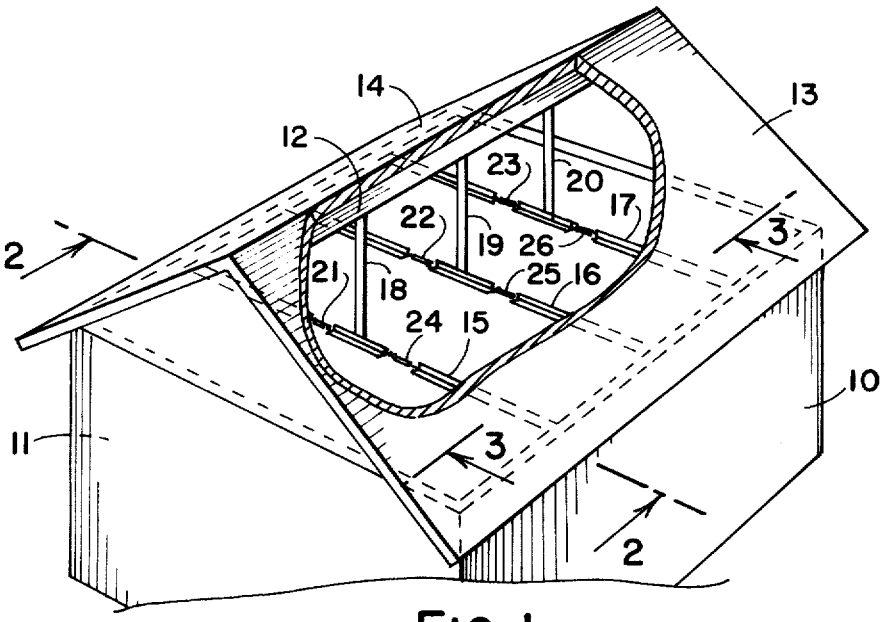
FIG. 1 is a fragmentary perspective view partly cut away of the prefabricated roof structure in accord with the present invention.

Refering first to FIG. 1 there are shown first and second opposite bearing walls 10 and 11 of a building. The prefabricated roofing structure includes a center ridge member 12 with roof sheets 13 and 4 secured to and slanting downwardly from the ridge member to overlie the upper edges of the opposite bearing walls 10 and 11.

A plurality of inverted T-bars 15, 16 and 17, by way of example, extend transversely of the ridge member between the upper edges of the bearing walls in spaced parallel relationship. Vertical hangers such as indicated at 18, 19 and 20 support the centers of the T-bars from the ridge member 12 as shown.

Each of the T-bars includes at least one turnbuckle means such as indicated at 21, 22 and 23 for the three T-bars 15, 16 and 17. In the particular embodiment illustrated, each of the T-bars may include a second turnbuckle means such as indicated at 24, 25 and 26 on the other side of the vertical hanger.

Figure 2:
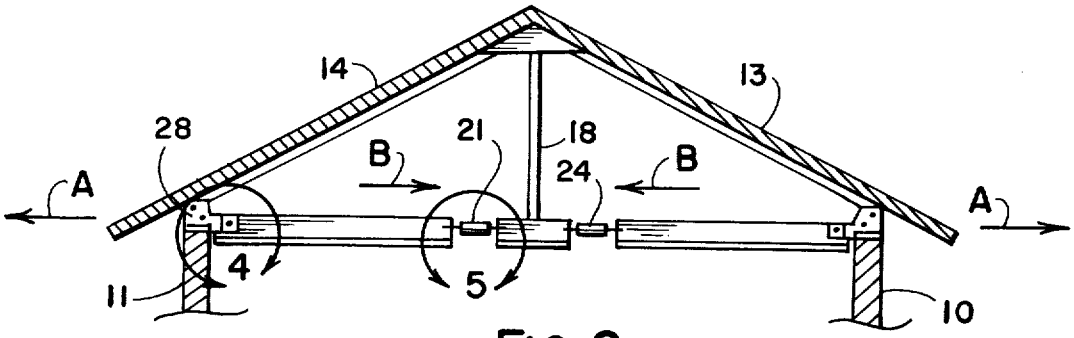
FIG. 2 is a cross section taken in the direction of the arrows 2—2 of FIG. 1.

Referring particularly to FIG. 2, the opposite ends of the various T-bars such as the T-bar 15 are secured to the upper edge of the bearing wall and the underside of the lower portion of the roof sheets as by brackets 27 and 28.

With the foregoing arrangement, the gravitational component of force tending to spread the lower ends of the roof panels 13 and 14 and thus the upper ends of the bearing walls 10 and 11 is indicated by the arrows A. This spreading force is counteracted by tightening of the turnbuckles 21 and 24 to exert a pulling force between the ends of the T-bar 15 as indicated by the arrows B. By careful adjustment of the turnbuckles, the bearing walls 10 and 11 can be brought into exact parallelism.

Figure 3:
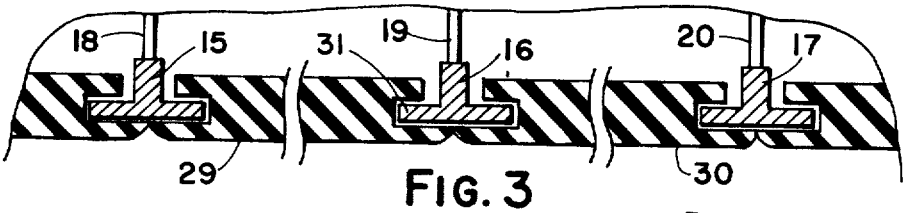
FIG. 3 is another cross section in fragmentary form taken in the direction of the arrows 3—3 of FIG. 1.

In accord with an important feature of this invention, the same T-bars which carry the counteracting force to the spreading forces also serve to support suitable ceiling panels. Thus, there are illustrated ceiling panels 29 and 30 in FIG. 3 supported on the inverted cross portion of the T-bars such as indicated at 31 for the T-bar 16. In certain instances, the ceiling panels may be of the false ceiling acoustical tile type provided in large 4×8 sheets which simply rest on the upper edges of the cross portion 31 of the T-bars or they may be more sophisticated panels provided with longitudinal grooves receiving the laterally extending cross portions of the T-bar construction such as illustrated in FIG. 3.

Figure 4:
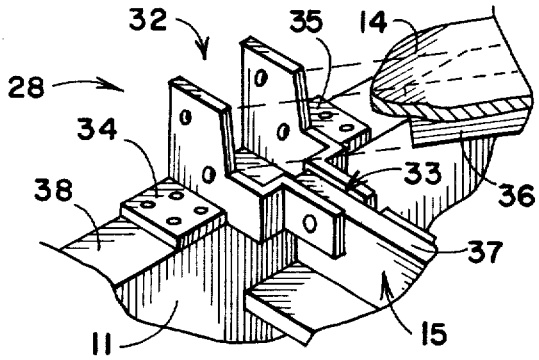
FIG. 4 is en enlarged fragmentary perspective view of one of the bracket means for securing various portions of the prefabricated roofing structure together enclosed within the circular arrow 4 of FIG. 2; and, FIG. 5 is a fragmentary perspective view of one of the turnbuckle means enclosed within the circular arrow 5 of FIG. 2.

Referring now to FIG. 4 details of one of the bracket means are illustrated. Since the various bracket means are the same, a detailed description of one will suffice for all. Thus, with reference to the bracket means 28, the structure takes the form of a metal plate bent to define an upwardly facing channel 32, an horizontally facing channel 33, and flat laterally extending bottom flanges 34 and 35. The roof sheets themselves normally include stiffening ribs such as indicated at 36 for the roof sheet 14 secured to their undersides. The arrangement is such that the end portions of the ribs are receivable in the upwardly facing channels such as the channel 32 to which they can be secured by passing suitable bolts or nails through the channel wall openings.

The vertical end portion of the T-bars indicated at 37, in turn, are received in and secured to the horizontally facing channels such as the channel 33 for the bracket 28. Finally, the laterally extending flanges 34 and 35 are secured to the upper edge of the bearing wall, the upper edge of the particular wall 11 illustrated in FIG. 4 being indicated at 38.

It will thus be appreciated that the single bracket secures together the upper edge of the wall, the end portion of the T-bar, and the underside lower portion of the roof sheet.

Figure 5:
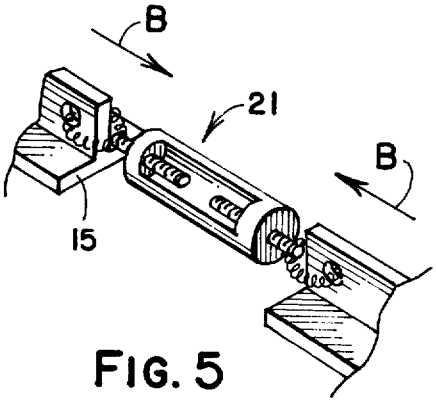

Referring to FIG. 5, there is shown in enlarged perspective view a typical one of the turnbuckles such as the turnbuckle 21 of FIG. 2. This turnbuckle is simply provided within a gap formed in the T-bar 15 and operates in the usual manner with oppositely threaded end portions receiving threaded studs such that rotation of the turnbuckle will exert the desired counteracting force tending to pull the ends of the T-bar 15 together as again indicated by the arrows B in FIG. 5.

From the foregoing description, it will thus be apparent that the present invention has provided a simple and economical prefabricated roof structure wherein the T-bars incorporating the turnbuckles not only function to provide the necessary counteracting force to the natural tendency for the roof sheets to spread but also provide support means for ceiling panels.

What is claimed is:

1. A prefabricated roofing structure for a building having opposite bearing walls comprising, in combination:

a. a center ridge member;

b. roof sheets secured to and slanting downwardly from said ridge member to overlie the upper edges of said opposite bearing walls;

c. a plurality of inverted T-bars extending transversely of said ridge member between the upper edges of said bearing walls in horizontal spaced parallel relationship;

d. vertical hangers extending from said ridge member to the centers of the T-bars to support the T-bars;

e. bracket means securing the ends of the T-bars, the upper edges of the bearing walls and the lower end portions of the roof sheets together;

f. turnbuckle means in each of the T-bars so that a contracting force pulling the ends of the bars towards each other can be applied; and, g. ceiling panels extending between the T-bars and supported by the inverted cross portions of the T-bars.

2. A structure according to claim 1, in which each of said bracket means comprises a metal plate bent to define an upwardly facing channel, an horizontally facing channel, and flat laterally extending bottom flanges, said roof sheets including stiffening ribs secured to their undersides, the end portions of the ribs being secured in the upwardly facing channels, the vertical end portions of the T-bars being secured in the horizontally facing channels, and the laterally extending flanges being secured to the upper edges of the bearing walls, tightening of said turnbuckle means providing a pulling force countering the gravitational force components tending to spread apart the roof sheets and bearing walls.

* * * * *